US005505403A

United States Patent [19]

Raudaskoski

[11] Patent Number: 5,505,403

[45] Date of Patent: Apr. 9, 1996

[54] DRUM WINDER AND METHOD FOR DRUM WINDING A WEB

[75] Inventor: Vesa Raudaskoski, Järvenpää , Finland

[73] Assignee: Valmet Paper Machinery, Inc., Helsinki, Finland

[21] Appl. No.: 260,090

[22] Filed: Jun. 15, 1994

[30] Foreign Application Priority Data

Jun. 30, 1993 [FI] Finland ..... 933011

[51] Int. Cl.[6] ..... B65H 18/26

[52] U.S. Cl. ..... 242/527.3; 242/541.4

[58] Field of Search ..... 242/527.3, 541.4, 242/541.7, 542

[56] References Cited

U.S. PATENT DOCUMENTS

| | | | |
|---|---|---|---|
| 3,346,209 | 10/1967 | Cronin . | |
| 3,497,151 | 2/1970 | Voss et al. . | |
| 3,515,183 | 6/1970 | Voss | 242/541.7 |

FOREIGN PATENT DOCUMENTS

| | | |
|---|---|---|
| 1047001 | 12/1958 | Germany . |
| 1111496 | 7/1961 | Germany . |
| 2920707 | 12/1980 | Germany . |
| 3618955 | 12/1987 | Germany . |
| 9110490 | 11/1991 | Germany . |
| 9112927 | 1/1992 | Germany . |
| 60-232358 | 11/1985 | Japan . |
| 2070495 | 9/1981 | United Kingdom . |
| WO92/03366 | 3/1992 | WIPO . |

*Primary Examiner*—John P. Darling
*Attorney, Agent, or Firm*—Steinberg, Raskin & Davidson

[57] ABSTRACT

A drum winder and method for winding a web in a drum winder, in which winding drums support a roll that is being formed and a cutter device cuts the web before a new winding is started on an empty roll spool. The cutter device has a cutter blade, an actuator, and a power transmission system operatively coupled to the cutter blade of the cutter device so that the movement of the actuator is transferable by the power transmission arrangement to the cutter blade. The cutter blade is movable along a curved path of movement so that the position of the cutter blade in its lower position is substantially more distant from one of the winding drums than it is in its upper position. On the blade beam of the cutter blade, seal units are arranged to seal the winding drums from below. The gap between the winding drums is sealed from above by an upper end-seal unit, whereby the gap between the winding drums can be pressurized. On the blade beam of the cutter blade, a sealing doctor blade may be arranged. The blade beam is provided with an end seal.

19 Claims, 5 Drawing Sheets

DRUM WINDER AND METHOD FOR DRUM WINDING A WEB

BACKGROUND OF THE INVENTION

The present invention relates to a drum winder including winding drums that support a roll that is being formed, i.e., onto which a web is being wound, and which is provided with a cutter device for cutting the web after the roll has reached a desired size and before the web begins to wind onto a new empty roll spool. The cutter device comprises a cutter blade, an actuator, and power transmission means operationally connected to the cutter blade of the cutter device so that the movement of the actuator is transferable by means of the power transmission means to the cutter blade. In this manner, the cutter blade moves along a curved path of movement so that the position of the cutter blade in the lower position is substantially more distant from the winding drum than it is in the upper position.

The present invention also relates to a method for winding a web onto a roll in a drum winder in which the web is supported on winding drums and a gap formed between the winding drums and the roll is pressurized.

In drum winding, it is desirable to lower the linear nip loads produced by the weight of the growing roll, because otherwise the linear loads that act in the nips will become excessively high, causing defects in the roll.

With respect to the prior art, reference is made to the publications DE 1,047,001, DE 1,111,496, DE 3,618,955, and U.S. Pat. No. 3,497,151. In the devices described in these prior art references, it is known to pass a pressure into the gap formed by the roll that is being formed and by the winding drums, whereby a relief effect is applied to the roll that is formed. As a result of this effect, the linear loads in the nips cannot become excessively high. In order that the pressure should be retained in the gap formed by the roll and by the winding drums, it is known from the prior art to seal the gap from above and from below, respectively, by means of various sealing constructions. From the publication DE 1,047,001, it is known to move the upper roll-end sealing unit in an axial direction of the roll.

In addition, from U.S. Pat. No. 3,346,209, it is known to regulate the pressure present in the gap formed by the roll and the winding drums by moving the lower drum in a substantially vertical direction, i.e., up and down.

Even though by means of the prior art devices described above, considerable improvement in the winding of a web onto a roll is achieved, they involve certain drawbacks. For example, sealing of the gap formed by the roll that is formed and the winding drums is generally problematic. The pressure always leaks to some extent, which results in problems of dust formation. Owing to the leakage of the pressure, a very large quantity of air is needed to maintain the pressure, which air spreads into the working environment, for which reason the dust is readily separated from the web that is wound and spreads into the working environment.

Moreover, the prior art devices restrict or at least hamper some operations that are necessary in the roll formation. One of these operations is the roll change wherein when the roll that is being wound becomes complete, a new roll spool must be fed into the gap between the winding drums, the web that is wound must be cut off, and the end of the cut-off web must be attached to the new roll spool. Thus, during roll change operations, various actuators are needed, such as web holders, cutting means, devices for the feed of a new roll spool, etc.

In the assignee's Finnish Patent Application No. 902890 of earlier date (corresponding to the assignee's U.S. patent application Serial No. 07/713,137, the specification of which is incorporated by reference herein), a cutter device is described for a web winder. The cutter device comprises a frame construction and a cutter blade for cutting the web in the roll formed on support of the winding drums before a new winding is started onto an empty roll spool. The cutter device comprises an actuator and power transmission members operatively connected to the cutter blade of the cutter device so that the movement of the actuator is transferable by means of the power transfer members to the cutter blade. In this arrangement, the cutter blade is movable along a curved path of movement so that the position of the cutter blade in its lower position is substantially more distant from the carrier drum than in its upper position. If necessary, such a cutter device may be connected with a blower device for holding the cut-off web end, a web holder, and/or a threading member for the web being wound onto the new, empty roll spool. The cutter blade of the cutter device moves along a curved path of movement into the gap between the winding drums, for example, from below the gap.

By means of a cutter device described in FI Pat. Appl. 902890, an advantage is obtained in that it is not necessary to make any installation pit for the frame construction of the cutter device, e.g., in the floor of the production plant. The cutter device can be attached to the frame of any drum winder whatsoever. In addition, it is easy to attach other accessories to the cutter device that are necessary for carrying out the roll change operation. Such accessories include, for example, the above blower for holding the cut-off web end, the web holder, and the threading device, etc.

OBJECTS AND SUMMARY OF THE INVENTION

Accordingly, it is an object of the present invention to provide an improvement over the prior art methods of drum winding and drum winders.

It is another object of the present invention to provide a drum winder, and method for drum winding a web, that have the same advantages as so-called pressure winders but in which some drawbacks present in the prior art devices are avoided.

The objects of the invention stated above, and others, are achieved by providing a drum winder with seal units arranged on the blade beam of the cutter blade so as to seal the winding drums from below, i.e., the open space or gap between the winding drums and the roll being formed. The upper regions of the gap between the winding drums are sealed by means of an upper end-seal unit in itself known. By sealing the from above by means of the end seal units and roll being formed and from below by means of the seal units, the gap between the winding drums can be pressurized.

By means of the drum winder in accordance with the invention, the same advantages are obtained as by means of so-called pressure winders known from the prior art. However, in the drum winder in accordance with the invention, the actuators necessary for the roll change are already present, for which reason the invention does not produce any problems in the operation of the roll change devices. Also, the sealing problems symptomatic of the gap formed by the roll that is formed and by the winding drums is, in the drum winder in accordance with the invention, solved so that drawbacks present in the prior art devices are avoided.

In the method in accordance with the invention, a web is wound onto a roll supported on winding drums and a gap is formed between the roll and the winding drums. A cutter blade is arranged on a blade beam and then moved between a first position in which the cutter blade is distant from one of the winding drum and a second position in which the cutter blade operates against that winding drum. Sealing means are arranged on the blade beam for sealing a region of the gap between the winding drums and opposite the roll when the cutter blade is in the second position. In addition, end regions of the gap can be sealed such that the gap is completely sealed, and then can be pressurized. The sealing means may be positioned against a second one of the winding drums opposite the winding drum against which the cutter blade operates when the cutter blade is in the second position, and to provide a complete seal of the gap, an end seal is arranged between the blade beam and the cutter blade. The gap can be pressurized by directing air through the blade beam into the gap.

The invention will be described in detail with reference to some preferred embodiments of the invention illustrated in the figures in the drawing. The invention is, however, not confined to these embodiments alone.

BRIEF DESCRIPTION OF THE DRAWINGS

The following drawings are illustrative of embodiments of the invention and are not meant to limit the scope of the invention as encompassed by the claims.

DETAILED DESCRIPTION OF THE INVENTION

Figure 1:
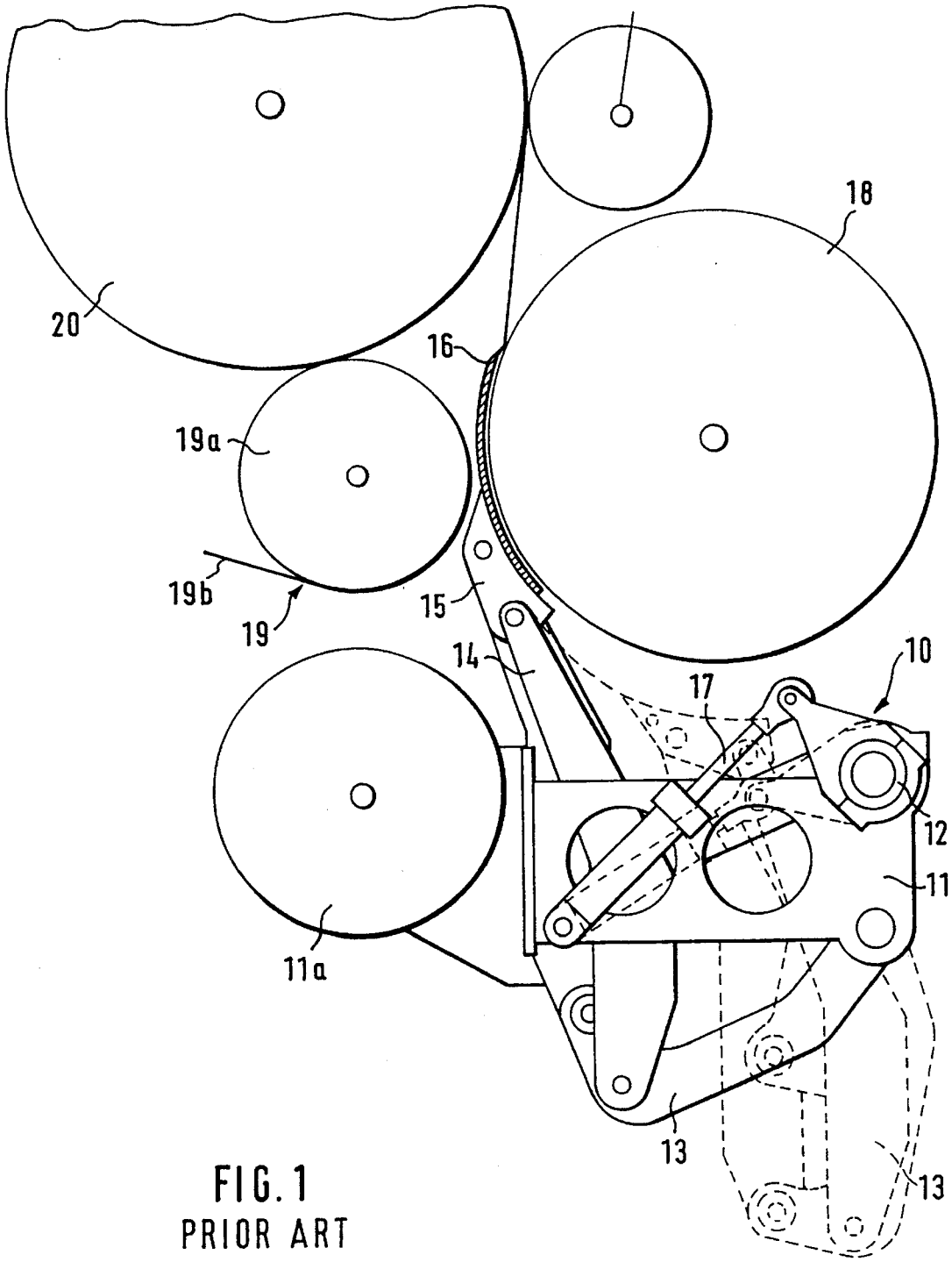
FIG. 1 PRIOR ART
FIG. 1 is a side view of a prior art drum winder having a web cutter.

Referring to the drawings, wherein the same reference numerals refer to the same elements, FIG. 1 shows a prior art cutter device 10 arranged for use in a drum winder. The cutter device 10 comprises a frame 11, a synchronizing pipe 12, a first set of pivotally fitted arms 13, a second set of pivotally fitted arms 14, a cutter blade 16, a frame or blade beam 15 for supporting the cutter blade 16 and an actuator 17 coupled at one end to the frame 11 and at an opposite end to the pipe 12. The frame 11 includes a frame pipe **11*a* arranged at one end thereof. The frame pipe 11*a* passes in the transverse direction through the drum winder to the other side. In FIG. 1, the cutter device 10 is applied to a drum winder that comprises an ordinary winding drum 18 and a winding drum 19 formed by a roll 19*a* and a second roll, which is not shown, and a belt 19*b*. The web roll 20 is formed as a web is wound thereon after passing over winding drum 18. The cutter blade 16 of the cutter device 10 is passed into the gap between the winding drums 18 and 19 from below the gap, or through any existing opening into the gap between the winding drum 18, roll 19*a* and roll 20. The cutter device 10** is attached to the frame construction of the drum winder by suitable means (not shown).

The cutter device 10 as shown in FIG. 1 operates as follows. The movement of the actuator 17, such as a hydraulic cylinder, acts upon the first set of arms 13, which are linked with the second set of arms 14 via a pivot point. The pivoting movement of the arms 13 is synchronized by means of the synchronizing pipe 12. The frame 15 of the cutter blade 16 is linked with the second set of arms 14. The movement of the actuator 17 is transferred by means of the arms 13 and 14 to the frame 15. As such, upon movement of the actuator, the frame 15 of the cutter blade 16, and the blade 16 attached thereto, causes a curved rotating movement of the blade 16 in relation to the face of the winding drum 18. This curved movement of rotation is selected so that the center of rotation of the circular movement of the cutter blade 16 is separate from the center of rotation of the winding drum 18. The center of rotation of the blade 16 can be freely selected as long as the center of rotation of the blade 16 does not coincide with the center of rotation of the winding drum 18. In FIG. 1, the dashed lines indicate the lower position of the cutter blade 16 and cutter device 10, and the corresponding solid lines indicates the upper position of the blade 16 and cutter device 10. As shown clearly in FIG. 1, in the lower position the cutter blade 16 is at a certain distance from the face of the winding drum 18, and in the upper position the cutter blade 16 is very close to the face of the winding drum 18.

The cutting proper of the web takes place because the blade 16 is sufficiently sharp to pierce the web that is placed tight on the roll 20. Alternatively, cutting of the web placed on the roll 20 may also take place so that the roll 20 is pushed by means of an ejector device in itself known, in which case the tight web forms a sufficient angle in relation to the cutter blade 16 causing the web to be cut off.

Figure 2:
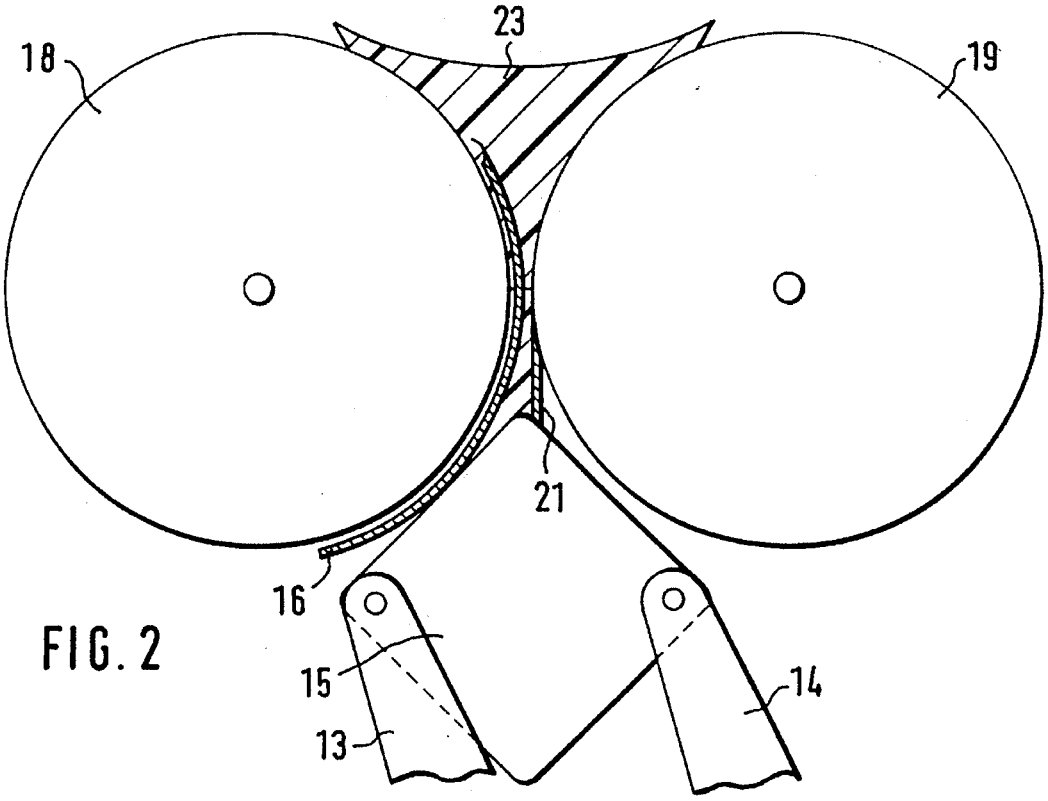
FIG. 2 is a side view of a first preferred embodiment of the drum winder in accordance with the present invention in the sealing/cutting position, and which is used in the method in accordance with the invention.
Figure 3:
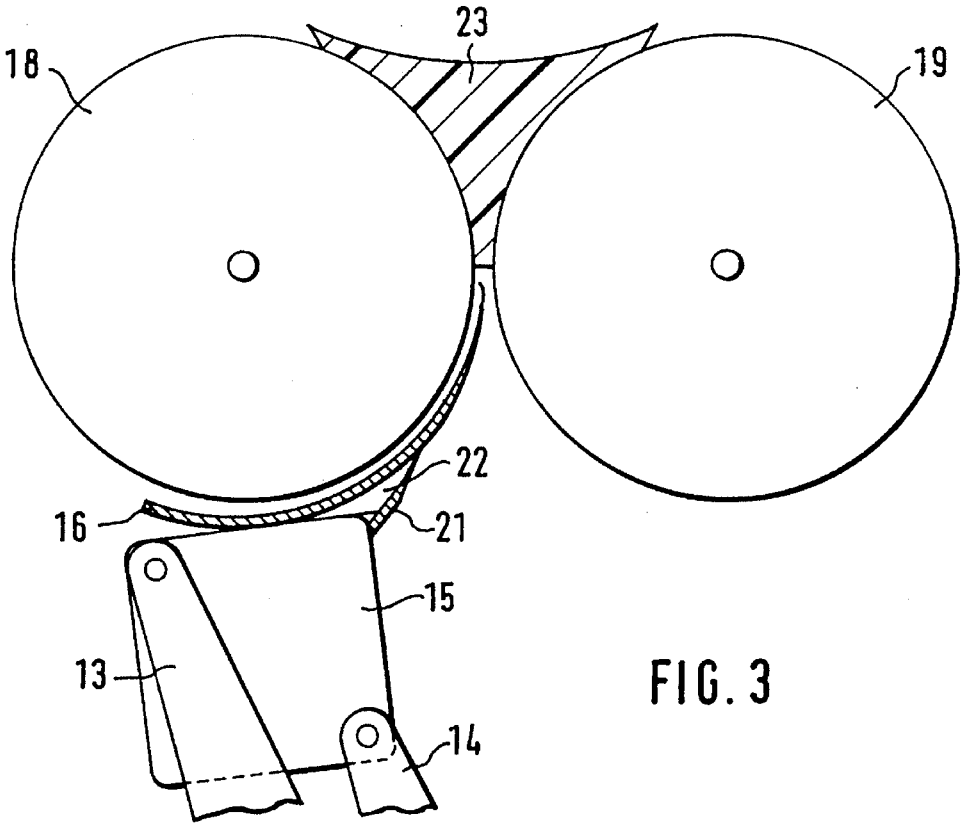
FIG. 3 is a side view of the drum winder as shown in FIG. 2 in the threading/cleaning/start-run position.

FIGS. 2 and 3 show the application of the present invention to the prior art device illustrated in FIG. 1. As shown in FIGS. 2 and 3, a sealing doctor blade 21 is arranged on the blade beam 15 of the cutter blade 16. An end seal 22 is arranged on the blade beam 15 between the doctor blade 21 and the cutter blade 16. An upper end seal 23 is arranged between the winding drums or rolls 18,19 and the roll being formed (not shown) which is supported by the winding drums or rolls 18,19. FIG. 2 shows the position of the blade beam of the cutter device 10 in its upper position in which the cutter blade 16 is in a position to cut the web against the face of the winding drum 18. The doctor blade 21 seals the space between the cutter device and the roll 19 as it abuts against the surface of the roll 19. FIG. 3 shows the position of the blade beam 15 of the cutter device 10 in its lower position when the cutter blade 16 is spaced from the winding drum 18.

In the gap between the ,winding drums 18 and 19, it is possible to supply air through the blade beam 15 in order to produce pressure in the gap. The blade beam 15 may, of course, be a sealing beam only in which case pressurized air is supplied into the gap between the winding drums 18 and 19 in some other way in order to produce pressure.

Figure 4:
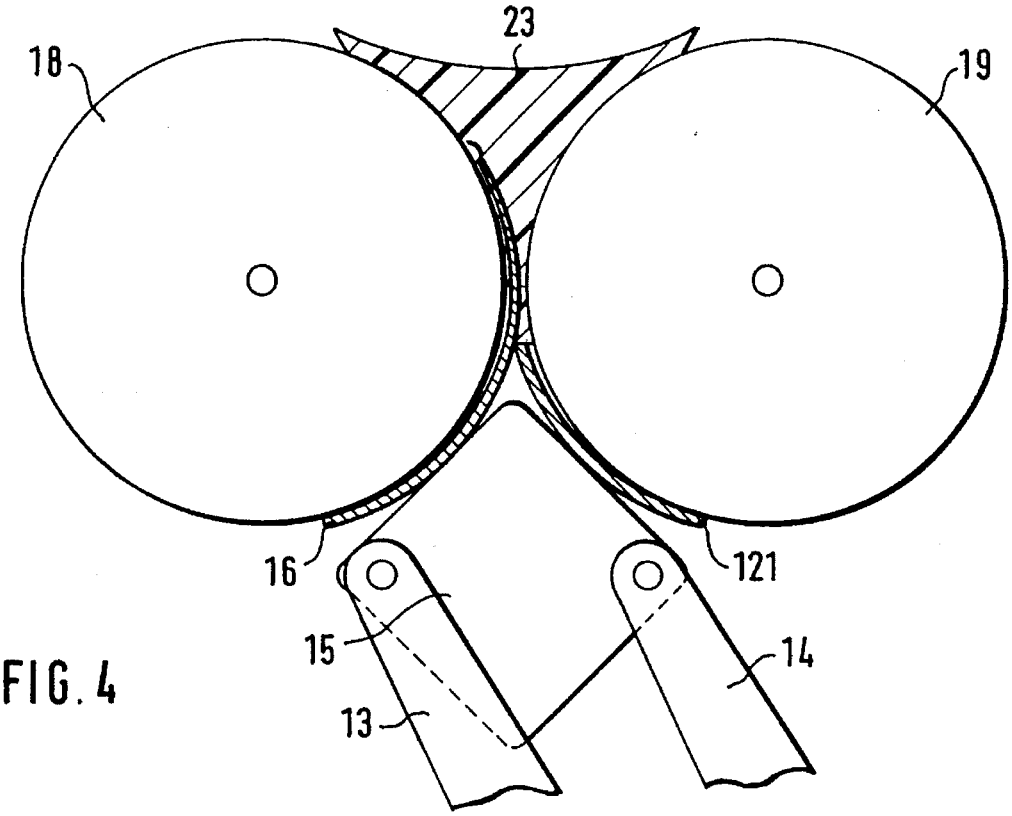
FIG. 4 is a side view of a second preferred embodiment of the drum winder in accordance with the invention in the sealing/cutting position, and which is used in the method in accordance with the invention.
Figure 5:
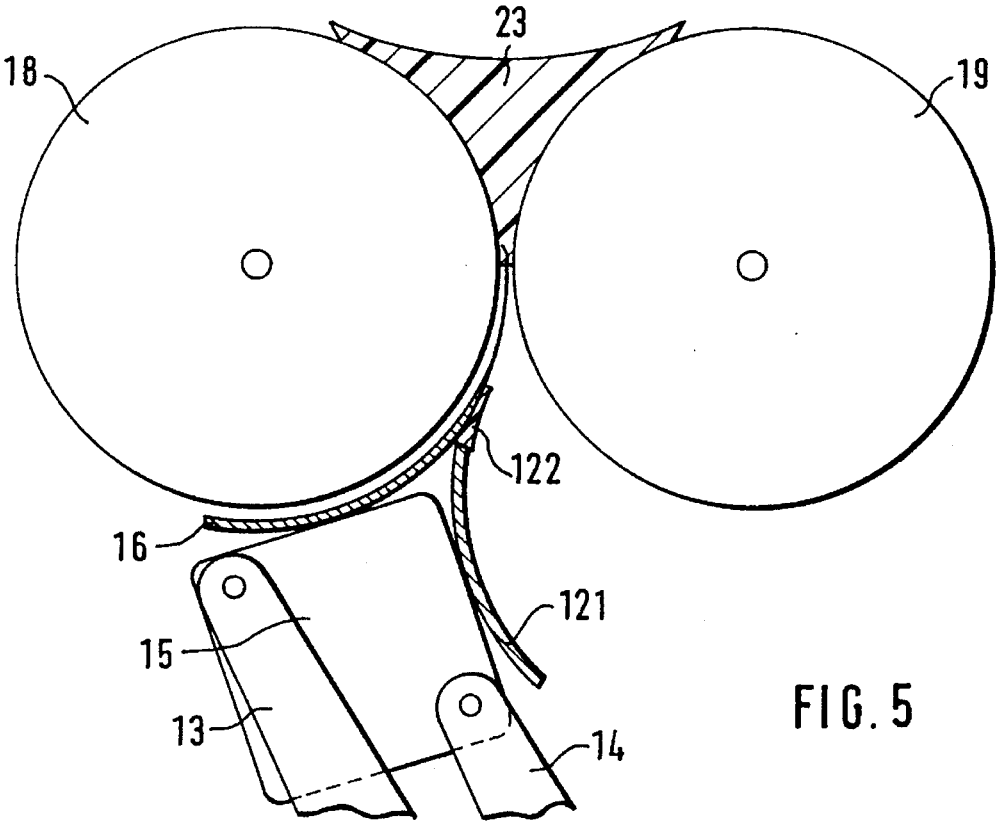
FIG. 5 is a side view of the drum winder as shown in FIG. 4 in the threading/cleaning/start-run position.

The embodiment shown in FIGS. 4 and 5 is in most respects similar to that shown in FIGS. 2 and 3 and can also be applied to the cutter device 10 shown in FIG. 1. However, in the embodiment of FIGS. 4 and 5, instead of the sealing doctor blade, a seal plate 121 is used to seal the space between the blade beam 15 of the cutter device 10 and the face of the winding drum 19. The seal plate 121 is preferably a curved seal plate having a curvature corresponding to the curvature of the winding drum 19. An end seal 122 of the beam is arranged on the seal plate to seal any gap or space between the seal plate 121 and the cutter blade 16. In this embodiment, the supply of air into the gap between the winding drums 18 and 19 can be carried out through the blade beam 15, or the blade beam 15 may operate as a seal unit itself, in which case the air is supplied in some other way in itself known in order to produce pressure in the gap between the winding drums 18 and 19.

Figure 6:
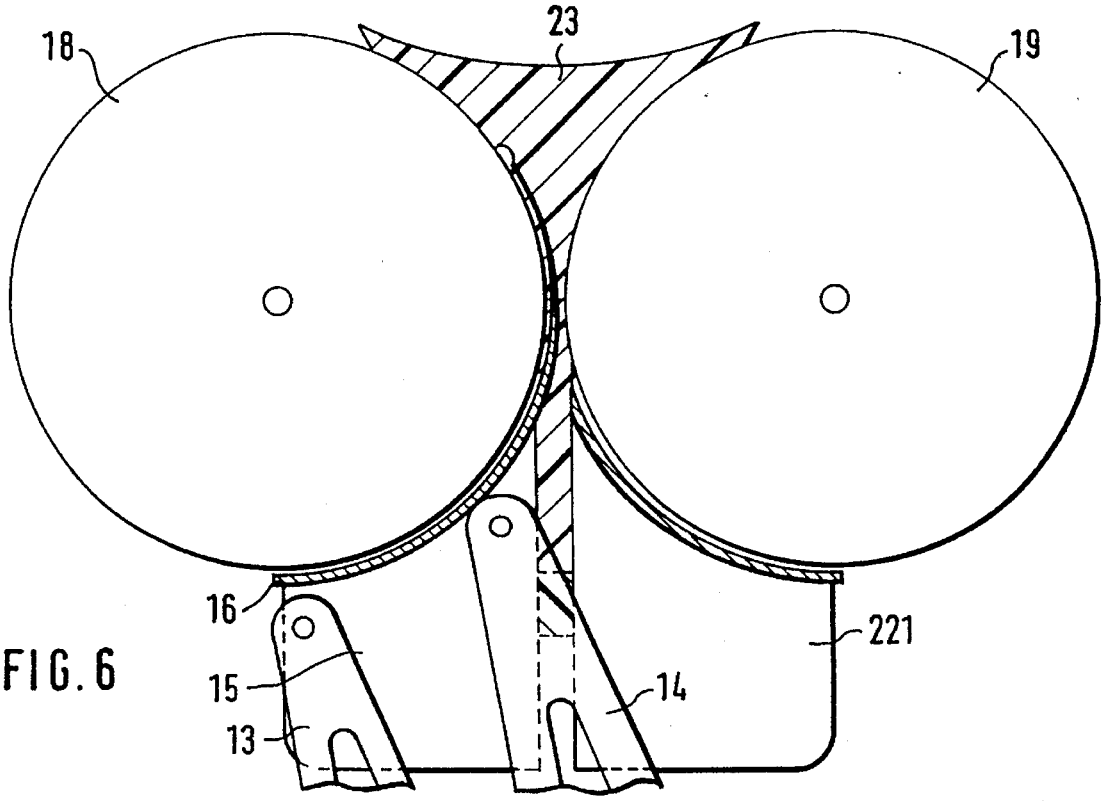
FIG. 6 is a side view of a third preferred embodiment of the drum winder in accordance with the invention in the sealing/cutting position, and which is used in the method in accordance with the invention.
Figure 7:
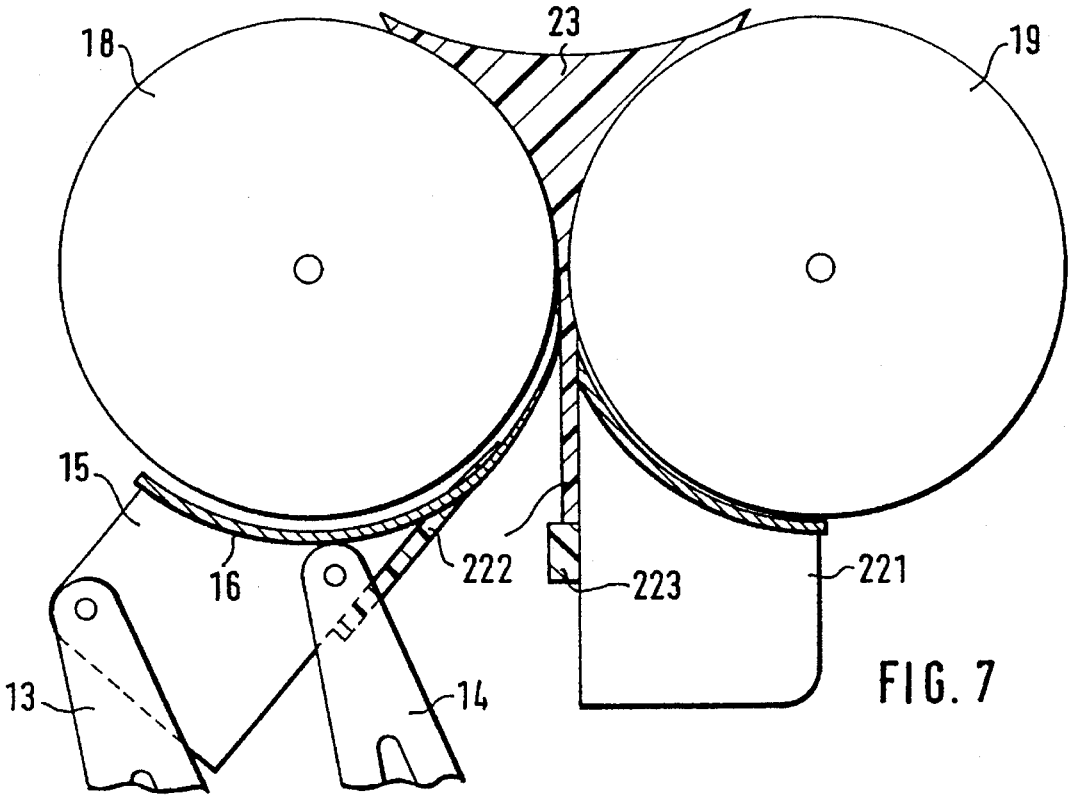
FIG. 7 shows the embodiment as shown in FIG. 6 in the threading/cleaning/start-run position.

In the embodiment shown in FIGS. 6 and 7, the sealing of the gap between the winding drums 18 and 19 from below, i.e., opposite to the roll being formed, is produced by means of an end seal 222 having one seal part situated on the blade beam 15 and another similar seal part situated on a stationary box 221 positioned adjacent to the winding drum 19. An intermediate seal 223 is arranged between the blade beam 15 and the stationary box 221, underneath the end seal 222, and is coupled to either the stationary box 221 or the blade beam 15. If necessary, the stationary box 221 can be lowered, e.g., to clean or move the winding drum 19. Also in this embodiment, air can be supplied into the gap between the winding drums 18 and 19 as described in the preceding embodiments.

Figure 8:
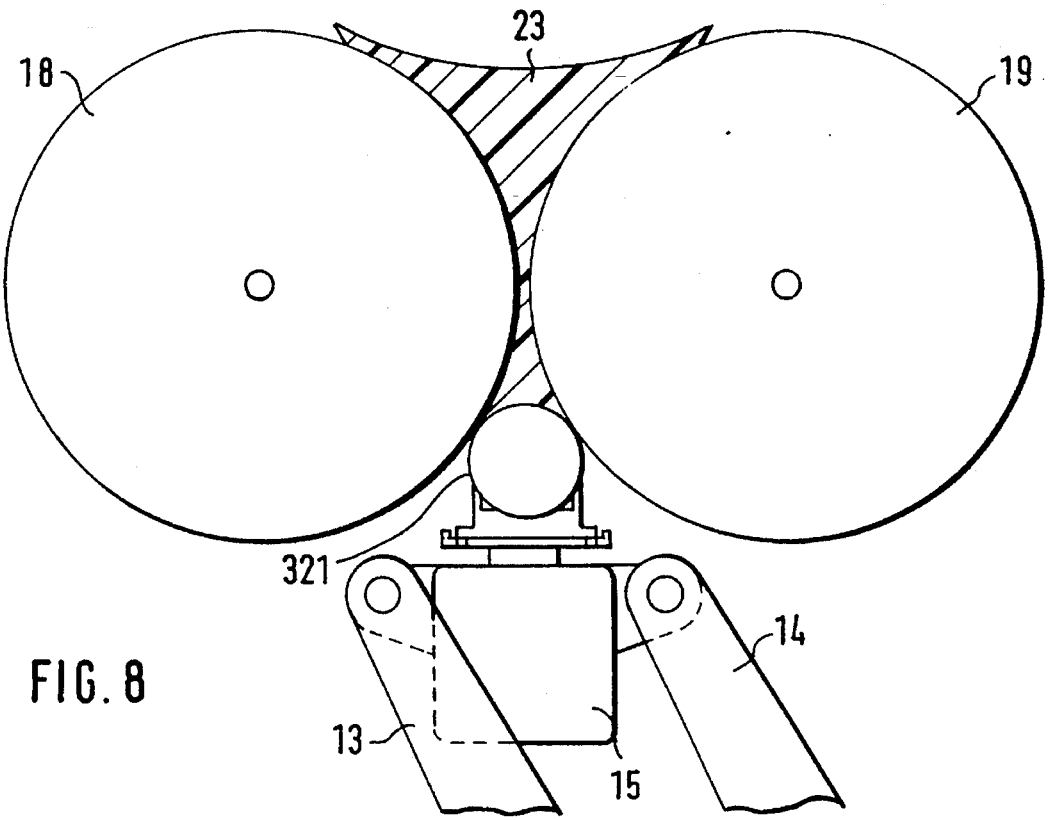
FIG. 8 shows a fourth preferred embodiment of the drum winder in accordance with the invention in the sealing position, and which is used in the method in accordance with the invention.
Figure 9:
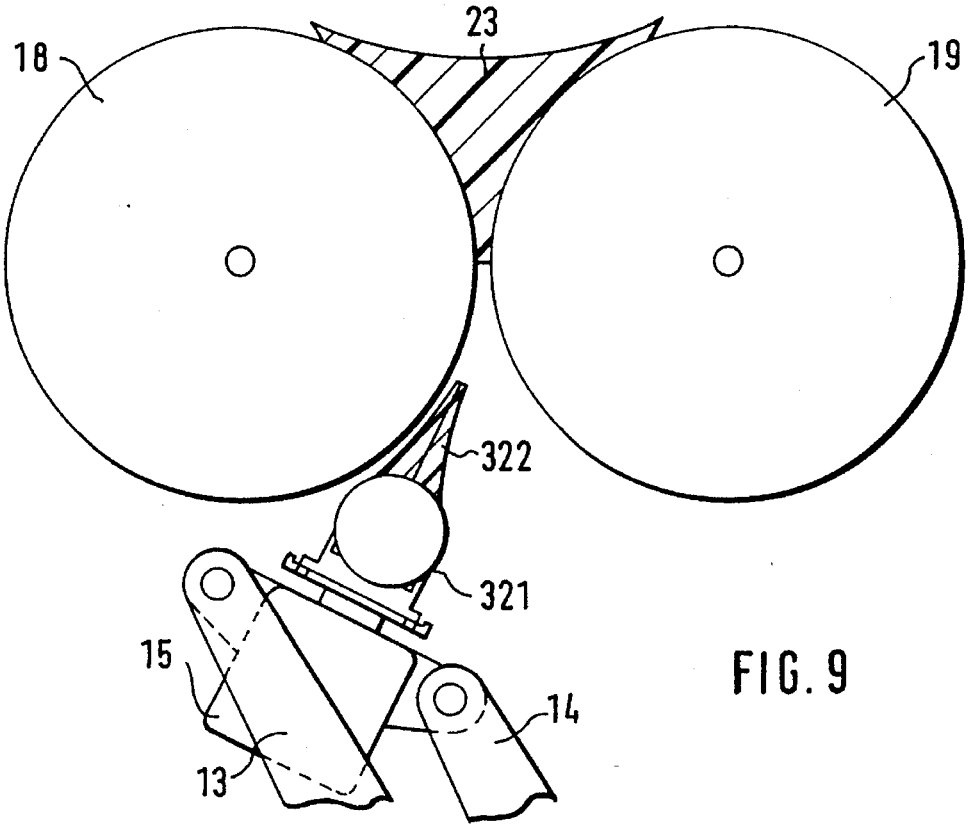
FIG. 9 shows the embodiment as shown in FIG. 8 in the threading/cleaning/start-run position.

In the embodiment shown in FIGS. 8 and 9, the cutter blade 16 has been removed from the beam 15, and a seal roll 321 is arranged on the beam 15. An end seal 322 is arranged on the seal roll 321 to seal the gap between the winding drums from below. Air can be supplied into the gap between the winding drums 18 and 19 as described in the preceding embodiments, e.g., air can be supplied through the blade beam 15 or the seal roll 321 into the gap to pressurize the same. The web is cut when necessary by cutting means not shown in the illustrated embodiment.

Although, the invention is described with reference to FIGS. 2–9 in relation to the prior art cutter device shown in FIG. 1, the invention can also be applied equally as well in other cutter devices, such as those pressure winders having a pressurized gap between the winding drums and the roll being formed as a web is wound thereon.

The examples provided above are not meant to be exclusive. Many other variations of the present invention would be obvious to those skilled in the art, and are contemplated to be within the scope of the appended claims.

I claim:

1. In a drum winder comprising winding drums for supporting a roll that is being formed as a web is wound thereon and a cutter device for cutting the web, a gap being formed between said winding drums and said roll, said cutter device comprising a cutter blade arranged on a blade beam, an actuator, and power transmission means operatively coupled to said cutter blade such that movement of said actuator is transferable by said power transmission means to said cutter blade and said cutter blade is moved along a curved path of movement between a first position in which said cutter blade is spaced from a first one of said winding drums and a second position in which said cutter blade operates against said first winding drum, the improvement comprising sealing means arranged on said blade beam for sealing a region of said gap between said winding drums and opposite said roll when said cutter blade is in said second position, and an end seal unit for sealing end regions of said gap, such that said gap is completely sealed and pressurizable.

2. The drum winder of claim 1, wherein said sealing means comprise a sealing doctor blade positionable against a second one of said winding drums opposite said first winding drum, and an end seal arranged between said blade beam and said cutter blade.

3. The drum winder of claim 1, wherein said sealing means comprise a seal plate positionable against a second one of said winding drums opposite said first winding drum, said seal plate comprising an end seal for sealing said seal plate against said cutter blade.

4. The drum winder of claim 3, wherein said seal plate comprises a curved seal plate having a curvature corresponding to the curvature of said second winding drum.

5. The drum winder of claim 1, wherein said sealing means comprise a stationary box positionable against a second one of said winding drums opposite said first winding drum, the drum winder further comprising an end seal arranged on at least one of said blade beam and said stationary box, said end seal sealing said blade beam against said stationary box.

6. The drum winder of claim 5, further comprising an intermediate seal arranged on said stationary box underneath said end seal for sealing said blade beam against said stationary box.

7. The drum winder of claim 5, wherein said stationary box is movable away from said second winding drum.

8. The drum winder of claim 5, wherein said end seal sealing said blade beam against said stationary box is arranged on said blade beam.

9. The drum winder of claim 5, wherein said end seal sealing said blade beam against said stationary box is arranged on said stationary box.

10. The drum winder of claim 5, wherein said end seal sealing said blade beam against said stationary box comprises a first portion arranged on said stationary box and a second portion arranged on said blade beam in opposed relationship to said first portion on said stationary box.

11. The drum winder of claim 1, wherein said gap is pressurized by feeding air therein through said blade beam.

12. A drum winder including winding drums for supporting a roll that is being formed by winding a web thereon, a gap being formed between said winding drums and the roll, comprising a beam, a seal roll arranged on said beam for sealing a region of said gap between said winding drums and opposite the roll, an end seal arranged on said seal roll, an actuator, and power transmission means operatively coupled to said seal roll such that movement of said actuator is transferable by said power transmission means to said seal roll and said seal roll is moved between a first position in which said seal roll is spaced from a first one of said winding drums and a second position in which said end seal of said seal roll seals said region.

13. The drum winder of claim 12, wherein said gap is pressurized by feeding air therein through said blade beam.

14. The drum winder of claim 12, wherein said gap is pressurized by feeding air therein through said seal roll.

15. Method in winding of a web onto a roll supported on winding drums, wherein the web is wound over a first one of the winding drums onto the roll and a gap is formed between the roll and the winding drums, comprising the steps of:

arranging a cutter blade on a blade beam, moving said cutter blade between a first position in which said cutter blade is spaced from the first winding drum and a second position in which said cutter blade operates against said first winding drum, and sealing a region of said gap between said winding drums and opposite said roll when said cutter blade is in said second position.

16. The method of claim 15, wherein the sealing of the region of said gap between said winding drums and opposite said roll is achieved by arranging sealing means on said blade beam.

17. The method of claim 15, further comprising the steps of sealing end regions of said gap such that said gap is completely sealed, and pressurizing said gap.

18. The method of claim 15, further comprising the steps of positioning said sealing means against a second one of said winding drums opposite said first winding drum when said cutter blade is in said second position, and arranging an end seal between said blade beam and said cutter blade.

19. The method of claim 15, wherein the step of pressurizing said gap comprises directing air through said blade beam into said gap.

* * * * *